United States Patent [19]

Brown

[11] Patent Number: 4,912,961

[45] Date of Patent: Apr. 3, 1990

[54] STRUCTURE FOR SECURING A DIE TO A BOLSTER PLATE

[76] Inventor: Donald H. Brown, 19725 Somers, New Boston, Mich. 48164

[21] Appl. No.: 117,043

[22] Filed: Nov. 5, 1987

[51] Int. Cl.[4] ..... B21D 37/14

[52] U.S. Cl. ..... 72/462; 72/481

[58] Field of Search ..... 72/481, 482, 462, 448; 83/698, 700; 269/56, 58, 60, 91, 93, 65, 240, 246; 100/918

[56] References Cited

U.S. PATENT DOCUMENTS

| | | | |
|---|---|---|---|
| 3,229,791 | 1/1966 | Soman | 72/462 |
| 3,638,473 | 2/1972 | McElroy | 72/462 |
| 4,322,994 | 4/1982 | Muhr et al. | 72/481 |
| 4,520,919 | 6/1985 | Keitaro | 72/462 |

FOREIGN PATENT DOCUMENTS

| | | | |
|---|---|---|---|
| 382450 | 5/1973 | U.S.S.R. | 72/481 |

OTHER PUBLICATIONS

Eary and Reed, "Techniques of Pressworking Sheet Metal", 1974 ed., pp. 323, 332, 333.

*Primary Examiner*—David Jones

[57] ABSTRACT

Structure for and method of securing a die to a bolster plate. The structure comprises an L shaped clamp secured to the die at the bottom surface thereof by a bolt extending through the clamp and into the die and/or welding around the periphery of one end of the clamp and a T bolt positioned in the bolster plate releasably securing the clamp to the bolster plate. In accordance with the invention, the clamp includes a bevelled end and an offset lower surface to facilitate welding the clamp to the die and to minimize alignment tolerance requirements in securing the clamp to the die. The method includes the step of securing the clamp to the die adjacent the bottom surface of the die by either or both bolting and welding, and releasably securing the clamp to the bolster plate by means of a T bolt positioned in the bolster plate and extending through the clamp.

14 Claims, 1 Drawing Sheet

STRUCTURE FOR SECURING A DIE TO A BOLSTER PLATE

BACKGROUND OF THE INVENTION

1. Field of the Invention

The invention relates to securing a die to a bolster plate or the like, and refers more specifically to structure for and a method of securing a clamp permanently to a die and releaseably securing the clamp to the bolster plate.

2. Description of the Prior Art

In the past, dies have been secured to bolster plates and the like with clamps utilized in conjunction with T bolts and heel blocks. With such prior structure, a die is positioned on the bolster plate, a T bolt is selected of the proper length depending on the height of the die, a heel block is selected of the exact height of the die and is positioned adjacent the die in spaced relation thereto, the T bolt is positioned in a T slot in the bolster plate, and a clamp is positioned with one end of the top face of the die and the other end of the heel block and is secured in such position by the T bolt extending therethrough.

Such prior structure and method of securing a die to a bolster plate or the like requires a plurality of different length T bolts, heel blocks of different sizes to assure the availability of a heel block of the same height as the die or the ability to build up a heel block having the required height. Further, such structure and method provides a clamp and nut for the T bolt extending beyond the upper face of the die, which is undesirable. In addition, such structure and method generally requires two people to secure the die to the bolster plate, particularly if the die is an upper die since the blocks and clamp must be held in position while the nut is tightened on the T bolt with the die in the desired position on the bolster plate.

SUMMARY OF THE INVENTION

In accordance with the invention, there is provided a structure and method for securing a die to a bolster plate or the like, which permits the use of a single length T bolt for all dies regradless of the height thereof, which leaves the upper face of the die clear of any obstruction and requires no heel blocks. Further, the structure and method of the invention requires the clamp to always be readily available with the die and facilitates one man securing of the die to the bolster plate or the like.

The structure for securing a die to a bolster plate in accordance with the invention comprises an L shaped clamp having a short leg and a bifurcated longer leg. The shorter leg is bolted and may be welded to the die adjacent the bottom surface thereof so that the surface of the longer leg is coplanar with the bottom surface of the die.

In accordance with the method of the invention, the clamp secured to the die is releaseably secured to the bolster plate by means of a uniform length T bolt positioned in a T slot in the bolster plate and extending through the bifurcated leg of the clamp.

BRIEF DESCRIPTION OF THE DRAWINGS

FIG. 1 is an elevation view of prior art structure for securing a die to a bolster plate or the like.

DESCRIPTION OF THE PREFERRED EMBODIMENT

Figure 1:
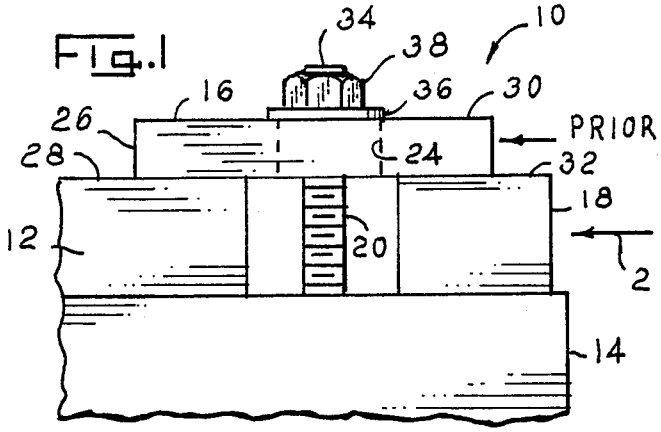
Figure 2:
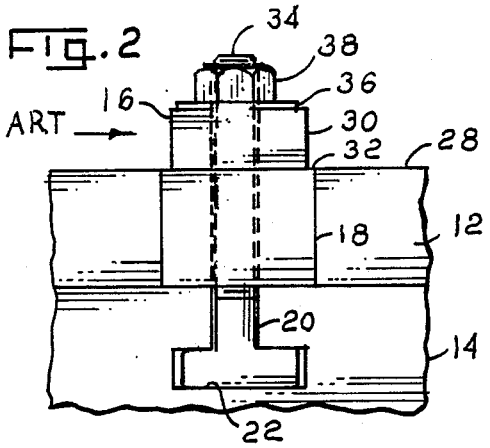
FIG. 2 is another elevation view of the prior art structure shown in FIG. 1, taken substantially in the direction of arrow 2 in FIG. 1.
Figure 3:
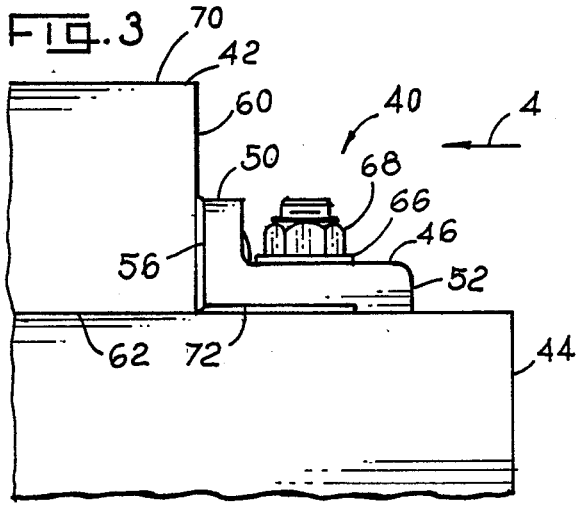
FIG. 3 is an elevation view of structure constructed in accordance with the invention for securing a die to a bolster plate, in accordance with the method of the invention.

The prior art structure 10 for securing a die 12 to a bolster plate 14 or the like is shown in FIGS. 1 and 2. As shown, the structure 10 includes a clamp 16, a heel block 18 and a T bolt 20.

In accordance with the prior method of securing the die 12 to the bolster plate 14, the die 12 is positioned on the bolster plate 14 as shown in FIG. 1 and a T bolt 20 is positioned in T slot 22 in the bolster plate 14. The heel block 18, which is the same height as the die 12 and which may be made up of a plurality of shorter heel blocks, is positioned on the bolster plate 14 in spaced relation to the die 12. Clamp 16, which has an elongated slot 24 therein, is positioned with one end 26 resting on top of the die 12 and with the other end 30 resting on the top 32 of the heel block 18. The end 34 of the T bolt 20 extends through the slot 24 in the clamp 16 and the washer 36 and nut 38 are utilized to secure the die 12, bolster plate 14, heel block 18 and clamp 16 in position in cooperation with the T bolt 20.

As particularly pointed out above, such structure is undesirable in that it requires the stocking of many different sizes of heel blocks 18 and T bolts 20. Further, the T bolts, heel blocks and clamps, particularly heel blocks and T bolts of the right heights, are not always readily available when it is desired to secure a die to a bolster plate. That is to say, these elements may be lost or misplaced in the typical shop environment.

Further, as indicated above, with the structure shown in FIGS. 1 and 2, the securing of a die 12 to a bolster plate or the like in the past has usually required the labor of two people. This is particularly true when securing an upper die to an upper bolster plate, since even with the die held in contact with the upper bolster plate by mechanical means, the heel block and clamp must be held in position while the washer and nut are secured to the T bolt to hold the assembly together.

In accordance with the invention, the structure 40, shown in FIGS. 3 through 6, for securing a die 42 to a bolster plate 44 includes the L shaped clamp 46 permanently secured to the die 42 and the T bolt 48 releaseably securing the clamp to the bolster plate.

As shown, the L shaped clamp has a short leg 50 and a longer, bifurcated leg 52. The shorter leg 50 is permanently secured to the die 42 while the longer leg 52 is releaseably secured to the bolster plate 44 by means of the T bolt 48.

The shorter leg 50 of the clamp 46 is bolted to the die 42 by the allen head machine bolt 54. In addition, the clamp leg 50 is welded to the die 42 around the periphery of the shorter leg 50. To facilitate the welding, the periphery of the shorter leg 50 of the clamp 46 on the side thereof opposite the longer leg 52 is bevelled.

Figure 4:
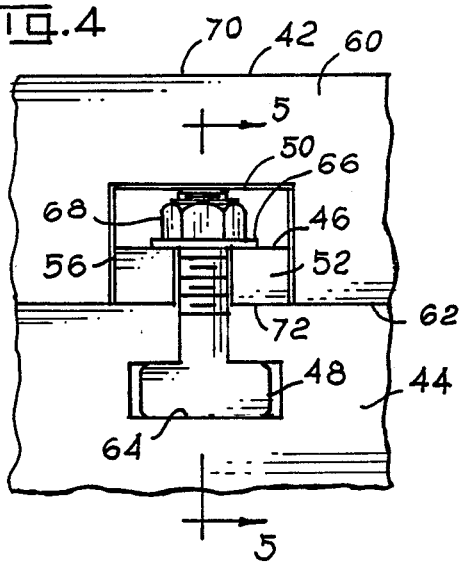
FIG. 4 is an elevation view of the structure illustrated in FIG. 3, taken substantially in the direction of arrow 4 in FIG. 3.

In accordance with the method of the invention, a hole 58 is first machined in the side 60 of the die 42 at a predetermined distance from the lower surface 62 thereof and is subsequently tapped to receive the bolt 54. The clamp 46 is bolted to the die 42 by means of the bolt 54 and is secured permanently in position on die 42 by the weld 56. The T bolt 48 is positioned in the T slot 64, as shown in FIG. 4, and the die 42 with the clamp 46 permanently secured thereto is positioned on the bolster plate 44. The clamp 46 is then releaseably secured to the bolster plate 44 by means of the washer 66 and the nut 68.

In accordance with the method of the invention for securing the die 42 to the bolster 44, it can readily be seen that no heel blocks are necessary, that the clamp 46 once secured to the die 42 is always readily available and that a standard height T bolt 48, that is a T bolt having a single height, may be utilized to secure a die 42 of any height to the bolster plate 44. Further, the upper face 70 of the die 42 will always be free from obstruction utilizing the structure and method of the invention. Also, it will be readily recognized that securing of the die 42 may be easily accomplished by a single person through the method of the invention utilizing the structure of the invention.

As will be readily understood by those in the art, the securing of the clamp 46 to the die 42 in accordance with the method of the invention requires that the hole 58 be drilled and tapped in the side of the die 60 at a predetermined distance from the bottom surface 62 thereof, so that with the bolt 54 initially securing the clamp 46 to the die 42, the bottom surface 72 of the clamp 46 will be coplanar with the bottom surface 62 of the die 42.

Figure 5:
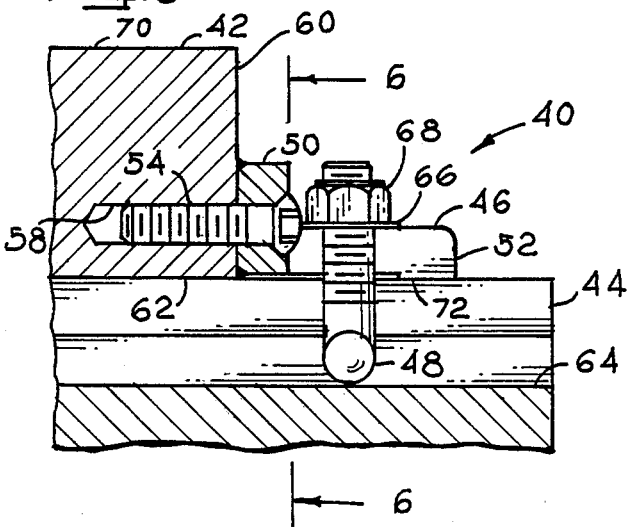
FIG. 5 is a partial section view of the structure illustrated in FIG. 4, taken substantially on the line 5—5 in FIG. 4.
Figure 6:
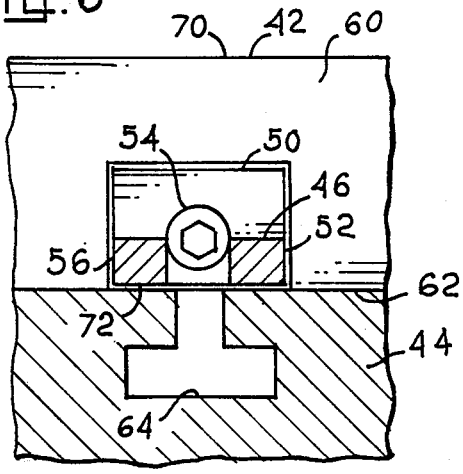
FIG. 6 is a partial section view of the structure illustrated in FIG. 4, taken substantially on the line 6—6 in FIG. 5.

To minimize problems due to slight misalignment of the bottom surface 62 of the die 42 and the bottom surface 72 of the clamp 46, the bottom surface 72 of the clamp 46 may be offset as shown in FIG. 5 for a portion of its length.

With the clamp 46 initially bolted to the die 42 in the desired position, the weld 56 may be accomplished to permanently secure the clamp 46 to the die 42. In addition, the bolt 54 provides a safety feature for top dies, should the weld fail for any reason.

However, it will be understood that where permanent securing of the clamp to the die is not desired, the welding of the clamp to the die with the attendant added cost is not required. In fact, in mant installations, the clamp will only be bolted to the die.

While one embodiment of the present invention has been considered above along with possible modifications thereof, it will be understood that other embodiments and modifications are contemplated. It will be understood that all embodiments and modifications as are defined by the appended claims are intended to be within the scope of the invention.

I claim:

1. In combination, a bolster plate, a separate die, a separate L-shaped clamp having two ends, means securing one end of the clamp to the die comprising a bolt extending through the one end of the clamp and into the die, and means releasably securing the other end of the clamp to the bolster plate.

2. Structure as set forth in claim 1 wherein the means securing the clamp to the die further comprises a weld between the the one end of the clamp and the die extending at least partly around the periphery of the one end of the clamp.

3. Structure as set forth in claim 1 and further including at least one T slot in the bolster plate, and wherein the means releasably securing the clamp to the bolster plate includes a T bolt extending within the T slot and through the other end of the clamp and a nut secured to the T bolt on the side of the other end of the clamp opposite the bolster plate.

4. Structure as set forth in claim 1 wherein the means securing the clamp to the die further includes a weld between the one end of the clamp and the die extending around at least part of the periphery of the one end of the clamp and wherein the bolster plate has at least one T slot therein and means releasably securing the clamp to the bolster plate comprises a T bolt positioned in the T slot and extending through the other end of the clamp and a nut secured to the T bolt on the side of the other end of the clamp opposite the bolster plate.

5. A separate clamp for securing a die to a bolster plate comprising an L shaped member having a shorter leg and a longer leg, the longer leg of which is bifurcated and a shorter leg of which includes a countersunk opening extending therethrough having an axis of generation extending parallel to the longer leg of the clamp.

6. Structure as set forth in claim 5 wherein the shorter leg of the clamp is bevelled around its periphery on the side of the shorter leg opposite the longer leg of the clamp.

7. Structure as set forth in claim 6 wherein the longer leg of the clamp has a bottom surface and the bottom surface of the longer leg is offset for a portion of its length.

8. Structure as set forth in claim 5 wherein the longer leg of the clamp has a bottom surface and the bottom surface of the longer leg is offset for a portion of its length.

9. In combination, a bolster plate, a separate clamp for securing a die to a bolster plate comprising an L shaped member having a shorter leg and a longer leg, the longer leg of which is bifurcated, separate means securing one end of the clamp to the die including a countersunk opening extending through the shorter leg of the clamp having an axis of generation extending parallel to the longer leg of the clamp and a bolt extending through the one end of the clamp and into the die and means for releasably securing the clamp to the bolster plate including a T bolt extending within the T slot and through the longer end of clamp and a nut secured to the T bolt on the side of the longer end of the clamp opposite the bolster plate.

10. Structure as set forth in claim 9 wherein the means for securing the clamp to the die further includes a weld between the shorter end of the clamp and the die extending at least partly around the periphery of the shorter end of the clamp.

11. Structure as set forth in claim 10 wherein the shorter leg of the clamp is bevelled around its periphery on the side of the shorter leg opposite the long leg of the clamp.

12. Structure as set forth in claim 11 wherein the longer leg of the clamp has bottom surface and the bottom surface of the longer leg is offset for a portion of its length.

13. In combination, a bolster plate, a separate die, a separate L-shaped clamp having two ends, means securing one end of the clamp to the die comprising a weld between the one end of the clamp and the die extending at least partly around the periphery of the one end of the clamp.

14. Structure as set forth in claim 13, and further including at least one T slot in the bolster plate, and wherein the means releasably securing the clamp to the bolster plate includes a T bolt extending within the T slot and through the other end of the clamp and a nut secured to the T bolt on the side of the other end of the clamp opposite the bolster plate.

* * * * *